US006036112A

United States Patent [19]

Hunsicker

[11] Patent Number: 6,036,112

[45] Date of Patent: Mar. 14, 2000

[54] FOAMING NOZZLE FOR TRIGGER SPRAYER

[75] Inventor: Michael Greggory Hunsicker, Lake St. Louis, Mo.

[73] Assignee: Continental Sprayers International, Inc., St. Peters, Mo.

[21] Appl. No.: 09/062,148

[22] Filed: Apr. 17, 1998

[51] Int. Cl.[7] ..... B05B 9/043; B05B 7/30

[52] U.S. Cl. ..... 239/333; 239/343; 239/428.5

[58] Field of Search ..... 239/343, 333, 239/428.5, 504

[56] References Cited

U.S. PATENT DOCUMENTS

| | | | |
|---|---|---|---|
| 2,961,171 | 11/1960 | Walsh . | |
| 3,672,574 | 6/1972 | Knapp | 239/428.5 |
| 3,709,433 | 1/1973 | Obergefell et al. . | |
| 4,350,298 | 9/1982 | Tada | 239/504 X |
| 4,603,812 | 8/1986 | Stoesser et al. | 239/428.5 X |
| 4,643,338 | 2/1987 | Iizuka . | |
| 4,771,919 | 9/1988 | Ernst . | |
| 4,796,812 | 1/1989 | Grollier . | |
| 4,921,170 | 5/1990 | Grollier . | |
| 4,991,779 | 2/1991 | Blake, III . | |
| 5,125,579 | 6/1992 | Eggert . | |
| 5,139,201 | 8/1992 | De Laforcade . | |
| 5,340,031 | 8/1994 | Neuhas et al. . | |
| 5,344,053 | 9/1994 | Foster et al. . | |
| 5,344,079 | 9/1994 | Tasaki et al. | 239/504 X |
| 5,366,160 | 11/1994 | Balderrama . | |
| 5,540,389 | 7/1996 | Knickerbocker . | |
| 5,647,539 | 7/1997 | Dobbs et al. . | |

FOREIGN PATENT DOCUMENTS

| | | | |
|---|---|---|---|
| 452208 | 10/1991 | European Pat. Off. | 239/343 |

*Primary Examiner*—Lesley D. Morris
*Attorney, Agent, or Firm*—Howell & Haferkamp, LC

[57] ABSTRACT

A trigger sprayer is constructed with a removable foamer insert that may be removed to allow the sprayer to dispense liquid only in a spray pattern or may be inserted to allow the sprayer to dispense liquid only in a foaming pattern. In addition, the foamer insert is specifically designed to generate a more even distribution of foam in the foaming pattern.

23 Claims, 3 Drawing Sheets

FOAMING NOZZLE FOR TRIGGER SPRAYER

BACKGROUND OF THE INVENTION (1) Field of the Invention

The present invention pertains to a trigger sprayer that discharges liquid in either a spray or foaming pattern. The trigger sprayer is constructed with a removable foamer insert that may be removed to allow the sprayer to dispense liquid only in the spray pattern or may be inserted to allow the sprayer to dispense liquid only in the foaming pattern. In addition, the foamer insert is specifically designed to generate a more even distribution of foam in the foaming pattern.

(2) Description of the Related Art

There are many various different types of manually operated trigger sprayers that are capable of generating foam from a spray of liquid dispensed from the sprayers. Many of these prior art trigger sprayers are dedicated foaming trigger sprayers, meaning that they can only dispense liquid in a foaming pattern. These sprayers usually have a permanent part of their assembly downstream from the liquid spray discharge of the sprayer that creates a turbulence in the spray discharge mixing air with the spray and generating a foam. Dedicated foamer trigger sprayers are often provided with a hinged door or other type of closure that enables an adjustment of the sprayer between on and off conditions, however the on condition always generates foam in the liquid spray dispensed from the trigger sprayer.

Many types of prior art trigger sprayers are not dedicated foamer sprayers. These may be trigger sprayers that are adjustable between spray and foaming conditions of the trigger sprayer. In the spray condition the liquid dispensed from the trigger sprayer is dispensed in a spray pattern. In the foam condition, the liquid dispensed from the sprayer is mixed with air to generate a foaming discharge from the trigger sprayer. Sprayers of this type are constructed with specific component parts that enable the adjustment between the spray and foaming condition of the sprayer discharge. In addition, some are provided with still further component parts in their specific constructions that enable adjustment between on and off conditions of the sprayer, and in the on condition enables further adjustment between a spray or foaming pattern of liquid discharged from the sprayer.

The prior art trigger sprayers that enable an adjustment between a spray and a foam pattern of liquid discharge from the sprayer have become very popular among consumers. The ability to adjust the pattern of liquid discharged between a spray pattern and a foaming pattern gives these sprayers an advantage over dedicated foaming trigger sprayers or dedicated spraying trigger sprayers. However, because there is more involved in their construction, a typical trigger sprayer that is adjustable between a spray and a foaming pattern of liquid discharge is more expensive to manufacture than a dedicated spray or foaming trigger sprayer. In addition, because many prior art trigger sprayers that dispense liquid in a spray and foaming pattern create a turbulence in the liquid spray discharge to generate a foam, the foam pattern of liquid discharge often has the same conical configuration as the spray pattern of liquid discharge. When it is desirable to cover a certain area with a foam from a trigger sprayer, often the pattern of foam dispensed from the trigger sprayer will be in an annular or ring configuration due to the conical pattern of spray discharged from the trigger sprayer from which the foam is generated.

Disadvantages of prior art foaming trigger sprayers could be overcome with an inexpensively constructed trigger sprayer that can be easily switched between a foaming or spraying trigger sprayer and which, when functioning as a foaming trigger sprayer, dispenses a more even distribution pattern of foam and not a ring of foam as often done in the prior art.

SUMMARY OF THE INVENTION

The trigger sprayer of the present invention is constructed as a dedicated liquid sprayer, however it is also provided with a foaming insert that generates a foam from the spray pattern of liquid dispensed from the sprayer. Furthermore, the particular construction of the insert enables it to generate a more uniform foaming pattern from the spray of liquid dispensed from the trigger sprayer.

Much of the construction of the trigger sprayer is conventional and several of the sprayer's component parts that perform a particular function may be replaced with other, known component parts that perform that same function. The sprayer is provided with a sprayer body that basically includes a liquid discharge passage, a pump chamber, a liquid supply passage and vent chamber. A threaded connector is provided at the bottom end of the sprayer housing and is employed in attaching the sprayer housing to a liquid filled container, for example a bottle of a liquid soap product. A dip tube is mounted in the liquid supply passage of the sprayer housing and extends down into the liquid of the container when the sprayer housing is attached to the container.

The liquid discharge passage, the pump chamber and the vent chamber all have center axes that are parallel and spaced from each other. A pump piston reciprocates in the pump chamber and a venting piston reciprocates in the vent chamber between charge and discharge positions of these two pistons. When moved to the charge position, the pump piston draws liquid from the container through the dip tube and supply passage and into the pump chamber. The vent piston connected to the pump piston blocks off venting communication when moved to its charge position. On movement of the pump piston to its discharge position, the liquid in the pump chamber is compressed and pumped to the discharge passage of the sprayer housing. When the vent piston moves to its discharge position with the pump piston, it opens up venting communication between the interior of the liquid container and the exterior environment of the trigger sprayer.

The liquid discharge passage has an upstream end with a valve seat and a downstream end with an outlet opening. A nozzle assembly is inserted into the liquid discharge passage at its outlet opening. The nozzle assembly has an orifice wall with a spray discharge orifice passing therethrough. A fluid spinner is contained in the nozzle assembly and the sprayer housing discharge passage. The fluid spinner has a swirl chamber at an end adjacent the nozzle orifice and a valve at its opposite end that seats in the valve seat of the liquid discharge passage. When the pump dispenses liquid from the pump chamber, the increased pressure of the dispensed liquid unseats the valve in the liquid discharge passage allowing liquid under pressure to pass through the passage to the orifice. On exiting the liquid discharge passage through the orifice, the fluid spinner spins the fluid just prior to its discharge resulting in a conical spray pattern of the liquid discharge from the trigger sprayer.

The sprayer housing of the trigger sprayer is provided with an outlet passage just downstream from the orifice wall and the spray discharge orifice of the trigger sprayer. The outlet passage has a cylindrical interior surface and has a very short length. The length of the outlet passage is sufficiently small so that the conical spray pattern of the liquid dispensed through the orifice will not come into contact with the interior surface of the outlet passage. In this manner, the length of the outlet passage does not interfere with the conical pattern of liquid spray generated by the swirl chamber of the spinner assembly and the discharge orifice of the trigger sprayer.

A foaming nozzle assembly is press-fit into the outlet passage of the sprayer housing. The foaming nozzle assembly is constructed with a cylindrical base having a cylindrical exterior surface that is complimentary to the cylindrical interior surface of the outlet passage. This enables the foaming nozzle assembly to be easily inserted into and pulled from the outlet passage. When it is desired to generate a foam from the liquid spray of the trigger sprayer, the foaming nozzle assembly is inserted into the outlet passage. When it is desired to dispense the liquid from the trigger sprayer in its conical spray pattern, the foaming nozzle assembly is removed from the outlet passage. The base of the foaming nozzle assembly also has a cylindrical interior surface that is slightly smaller than the cylindrical interior surface of the trigger sprayer housing outlet passage. Because the foaming nozzle interior surface is slightly smaller, a portion of the conical spray pattern dispensed through the trigger sprayer discharge orifice will contact the interior surface of the foaming nozzle assembly. This contact creates turbulence in the spray pattern which mixes it with ambient air inside the foaming nozzle assembly base and generates a foam from the portion of the spray that contacts the interior surface of the base.

In addition, a foaming generator is positioned at the downstream end of the foaming nozzle base. This foaming generator is comprised of a plurality of ribs that extend inwardly from the foaming nozzle assembly base toward the center axis of the base. The ribs extend to a disrupting member positioned at the center of the foaming nozzle assembly base. In the preferred embodiment of the invention, the disrupting member is a sphere. The plurality of ribs radiate outwardly from the sphere to the base defining a plurality of outlet orifices surrounding the sphere.

In operation, the conical pattern of liquid spray discharged from the discharge orifice passes into the interior of the foaming nozzle base inserted in the outlet passage of the trigger sprayer housing. A portion of this liquid spray contacts the interior surface of the base and is redirected by this contact back toward the center axis of the base while still traveling downstream from the discharge orifice. The remaining portion of the liquid spray discharged through the discharge orifice contacts the radiating ribs and the spherical disrupting member at the center of the ribs. This contact creates additional turbulence in the pattern of liquid spray discharged from the discharge orifice. This turbulence in the liquid spray discharge mixes the spray with air and generates a foam.

The spray liquid contacting the sphere at the center of the foamer nozzle assembly travels around the exterior surface of the sphere in a direction downstream from the trigger sprayer orifice. The liquid spray traveling over the surface of the sphere in the downstream direction also directs a portion of the generated foam discharge around the exterior surface of the sphere redirecting the discharge toward the center axis of the foaming nozzle assembly. In this manner, the spherical disrupting member pulls a portion of the generated foam in the conical spray pattern back toward the center axis of the spray pattern. This foam fills in the usual annular ring spray pattern generated by prior art foamers giving the foamer of the present invention the ability to dispense a more uniform and solid pattern of foam.

In other embodiments of the foaming nozzle assembly, the spherical disrupting member is replaced with a semi-spherical disrupting member and with a conical disrupting member.

BRIEF DESCRIPTION OF THE DRAWINGS

Further objects and features of the present invention are revealed in the following detailed description of the preferred embodiments of the invention and in the drawing figures wherein.

DETAILED DESCRIPTION OF THE PREFERRED EMBODIMENTS

Figure 1:
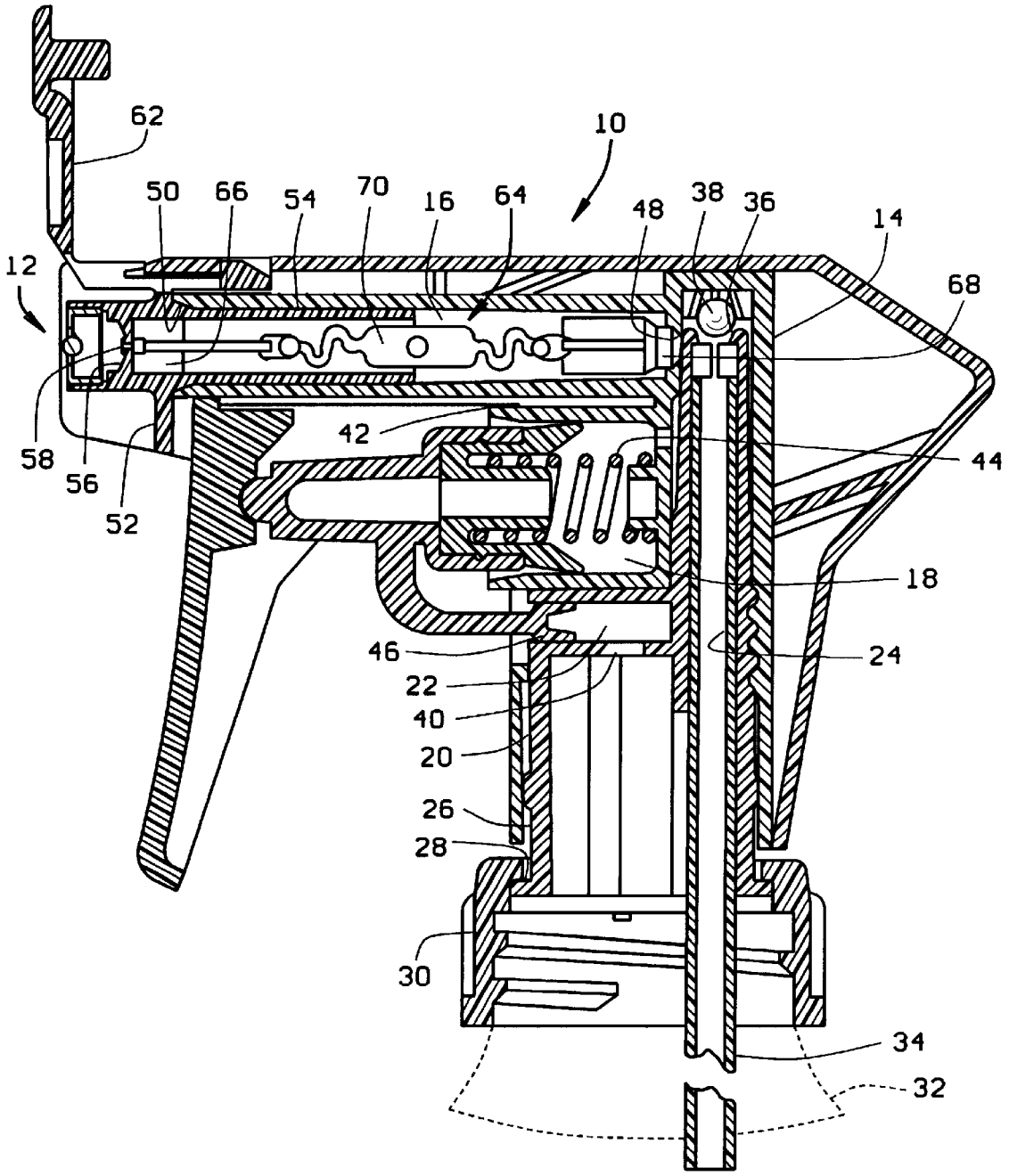
FIG. 1 is a side elevation view, in section, showing the trigger sprayer of the invention with the foaming nozzle assembly inserted in its outlet passage.

The foaming nozzle assembly of the present invention is intended for use with any typical type of trigger sprayer that dispenses liquid in a spray pattern and may also be used with trigger sprayers that dispense liquid in a stream pattern depending upon the particular configuration of the stream pattern. FIG. 1 of the drawing figures shows a typical trigger sprayer of the type with which the present invention is used. The sprayer shown in FIG. 1 is constructed as a dedicated liquid sprayer, however the foaming nozzle assembly of the present invention may be employed in other types of known trigger sprayers that are adjustable between on and off spraying conditions and are also adjustable to vary their spray pattern between spray and stream conditions.

The dedicated liquid sprayer 10 shown in FIG. 1 is provided with the foaming nozzle assembly 12 of the present invention that generates a foam from the spray pattern of liquid discharged from the sprayer. The particular construction of the foaming nozzle assembly 12 enables it to generate a more uniform foaming pattern from the spray of liquid dispensed from the trigger sprayer 10 as will be explained.

Much of the construction of the trigger sprayer 10 is conventional and several of the sprayer's component parts that perform a particular function may be replaced with other, known component parts that perform the same function. However, the foaming nozzle assembly 12 and the manner in which is its removeably attached to the trigger sprayer 10 is unique to the invention.

The trigger sprayer 10 shown in FIG. 1 is a modification of the trigger sprayer disclosed in the U.S. Pat. No. 5,344,053, of Foster et al. incorporated herein by reference. Because the construction and functioning of the trigger sprayer is fully disclosed in the above-referenced patent, it will only be generally described here.

The trigger sprayer is provided with a two piece body construction including an upper sprayer body 14 housing a liquid discharge passage 16 and a pump chamber 18, and a lower body portion 20 housing a vent chamber 22, a liquid supply passage 24 and a base 26 of the sprayer housing. The lower sprayer body portion 20 is inserted into the upper sprayer body portion 14 and together the upper and lower portions comprise the basic structural components of the sprayer body. In alternate embodiments, these basic structural components could all be formed in a unitary sprayer body.

The base 26 of the lower sprayer body portion is provided with an annular flange 28 on which is mounted a cap closure 30. The particular cap closure 30 disclosed in an internally threaded cap that is mounted on the base flange 28 for rotation in attaching the cap on a complimentary threaded neck of a liquid container 32 shown in dash lines in FIG. 1. Alternatively, the cap closure 30 may be replaced with a bayonet-type closure that may be formed integrally with the sprayer body. A dip tube 34 is inserted into the liquid supply passage 24 and extends downwardly into the liquid of the container 32 when the sprayer housing is attached to the container. The liquid supply passage 24 is provided with a valve seat 36 at its upper end on which a ball check valve 38 seats to control a flow of liquid through the dip tube 34 to the pump chamber 18, but prevent the return flow of liquid from the pump chamber through the dip tube. The vent chamber 22 has a cylindrical interior surface with a vent opening 40 passing through the bottom wall of the chamber and communicating the interior of the chamber with the interior of the liquid container 32 to which the sprayer is attached.

The liquid discharge passage 16 and the pump chamber 18 formed in the upper sprayer body portion 14 both have cylindrical interior surfaces. The liquid discharge passage 16, the pump chamber 18 and the vent chamber 22 all have center axes that are parallel and spaced from each other. A pump piston 42 reciprocates in the pump chamber 18 against the bias of a coil spring 44 and a vent piston 46 reciprocates in the vent chamber 22, both between charge and discharge positions of these two pistons. When moved to the charge position, the pump piston 42 draws liquid from the container 32 through the dip tube 34 and the supply passage 24 into the pump chamber 18. The vent piston 46 is connected to the pump piston 42 and also moves to a charge position with the pump piston, blocking off the vent opening 40 in the vent chamber 22 and sealing the interior of the container 32 from the exterior environment of the trigger sprayer. On movement of the pump piston 42 to its discharge position against the bias of the spring 44, liquid drawn into the pump chamber 18 is pressurized and pumped to the discharge passage 16 of the sprayer housing. When the vent piston 46 moves to its discharge position with the movement of the pump piston 42, it opens venting communication between the interior of the liquid container 32 and the exterior environment of the trigger sprayer through the vent opening 40 and the vent chamber 22.

The liquid discharge passage 16 has an upstream end with a valve seat 48 at the right end of the discharge passage as viewed in FIG. 1, and a downstream end with an outlet opening 50 to the left of the discharge passage as viewed in FIG. 1. The valve seat 48 surrounds an opening providing communication to the interior of the discharge passage 16. A nozzle assembly 52 is attached to the outlet opening 50. The nozzle assembly includes a conduit 54 that is inserted into the outlet opening 50 and extends a short distance into the discharge passage 16. The conduit 54 has a cylindrical interior surface and is opened at its right end as viewed in FIG. 1. An orifice wall 56 is provided at the left end of the conduit 54 as viewed in FIG. 1 and a discharge orifice 58 passes through the orifice wall. The discharge orifice 58 has a center axis 60 that is co-axial with the nozzle assembly conduit 54 and the sprayer housing discharge passage 16. The nozzle assembly 52 is also provided with a door closure 62 connected by a living hinge to the nozzle assembly. The living hinge permits the door closure 62 to be pivoted downwardly to a closed position and upwardly to an open position shown in FIG. 1.

A fluid spinner 64 is contained inside the nozzle assembly conduit 54 and the sprayer housing discharge passage 16. The fluid spinner has a swirl chamber 66 at its left end and a valve head 68 at its right end as viewed in FIG. 1. The swirl chamber 66 and valve head 68 are biased away from each other by a spring section 70. The swirl chamber 66 is conventional and imparts a spin to liquid pumped through the liquid discharge passage 16 and the swirl chamber 66 just prior to discharge of the liquid through the discharge orifice 58. The swirling action of the discharged liquid produces the conical spray pattern in the liquid sprayed from the discharge orifice 58. When the pump piston 42 is moved toward its discharge position pressurizing liquid in the pump chamber 18, the pressurized liquid unseats the valve head 68 from the valve seat 48 allowing the liquid to enter the liquid discharge passage 16 and pass through the swirl chamber 66 and the discharge orifice 58.

The construction of the trigger sprayer 10 described to this point is for the most part conventional and is not intended to be limiting on the subject matter of the invention to be described. Several component parts of the conventional trigger sprayer may be replaced with other known parts that function in the same way. For example, ball check valves could be replaced with flapper valves or other equivalent functioning valves. The piston pump could be replaced by an elastomeric bulb pump or other types of equivalently functioning pumps.

Figure 2:
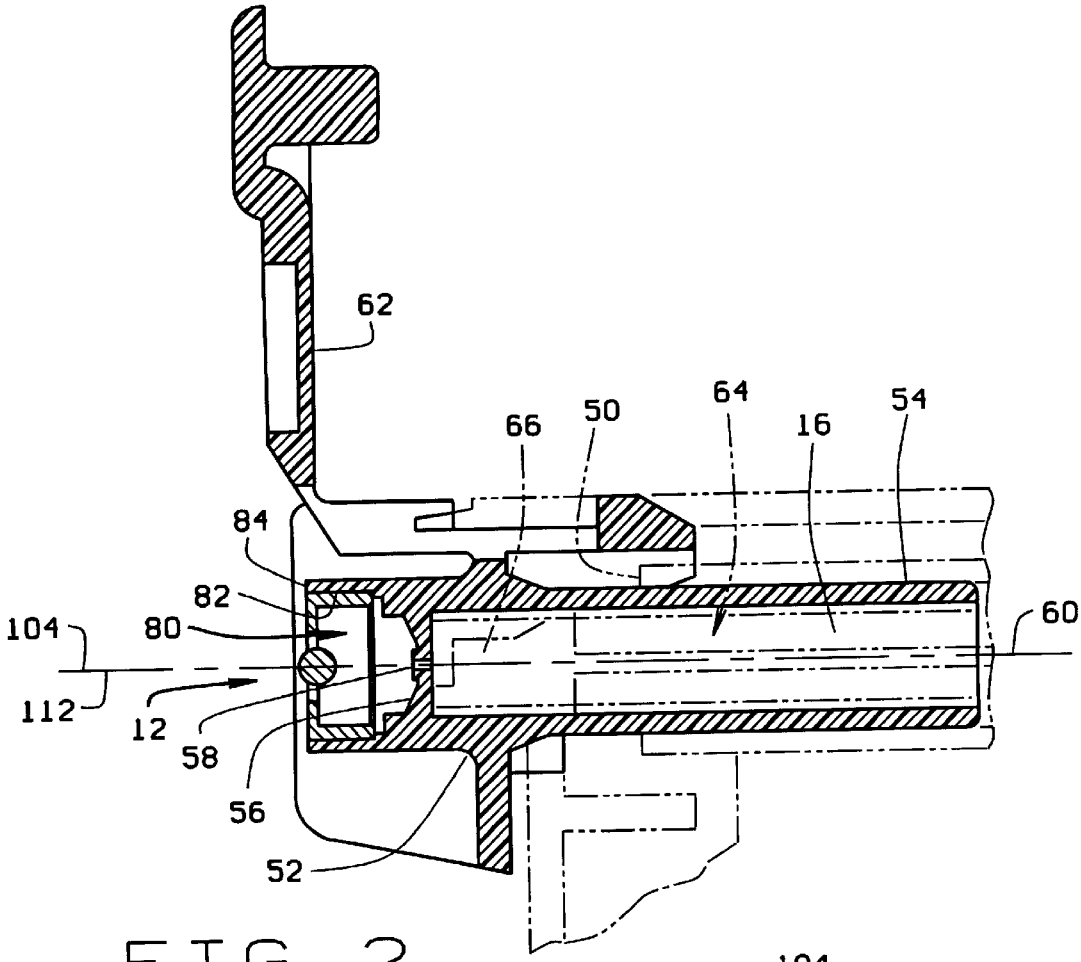
FIG. 2 is a partial view, in section, showing the discharge passage and outlet passage of the trigger sprayer and the foaming nozzle assembly in greater detail.

In the trigger sprayer of the present invention, the sprayer housing of the trigger sprayer is provided with an outlet passage 80 having a cylindrical interior surface 82 that extends just downstream from the orifice wall 56 or to the left from the orifice wall as viewed in FIG. 1 and in more detail in FIG. 2. The length to which the outlet passage 80 extends downstream from the discharge orifice 58 is chosen so that the outlet passage interior surface 82 does not interfere with the conical spray pattern of the liquid ejected from the discharge orifice 58. That is to say that the conical pattern of liquid ejected from the discharge orifice 58 when the trigger sprayer is manually actuated will pass through the opening at the distal end 84 of the outlet passage without contacting and being interfered with by the interior surface 82 of the outlet passage when the foaming nozzle assembly 12 is removed from the outlet passage 80.

Figure 3:
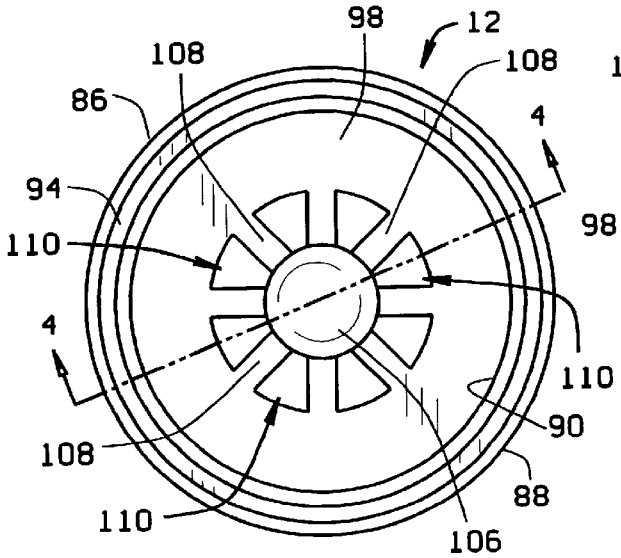
FIG. 3 is an upstream end elevation view of the foaming nozzle assembly removed from the trigger sprayer outlet passage.
Figure 4:
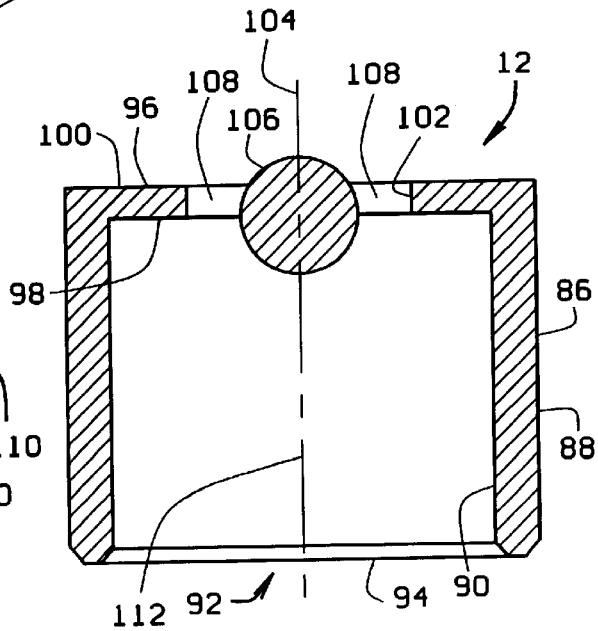
FIG. 4 is a cross-sectional view of the foaming nozzle assembly taken along the plane 4—4 of FIG. 3.

The foaming nozzle assembly 12 of the invention is shown press fit into friction engagement with the interior surface 82 of the outlet passage 80. The friction engagement also enables the foaming nozzle assembly 12 to be removed from the outlet passage interior surface 82. The foaming nozzle assembly 12 is shown in greater detail removed from the outlet passage in FIGS. 3 and 4. The foaming nozzle assembly 12 includes a cylindrical base 86 having a cylindrical exterior surface 88 and a cylindrical interior surface 90. The circumference of the exterior surface 88 corresponds to the circumference of the interior surface 82 of the outlet passage to provide a tight friction fit of the nozzle assembly 12 in the outlet passage 80. The base has an inlet opening or orifice 92 at its upstream end. As best seen in FIGS. 3 and 4, the annular edge 94 of the inlet opening 92 has chamfered surfaces to facilitate its insertion into the outlet passage 80. The base is provided with a front wall 96 at its opposite or downstream end. The front wall 96 has an interior, planar surface 98 that faces in the upstream direction of the foaming nozzle assembly and an opposite exterior, planar surface that faces in the opposite downstream direction of the nozzle assembly. A circular orifice 102 is provided through the center of the front wall 96. The orifice 102 has a center axis that is co-axial with the center axis 60 of the discharge orifice when the foaming nozzle assembly 12 is inserted in the outlet passage 80.

A disrupting member 106 is positioned at the center of the front wall orifice 102. A plurality of spaced ribs 108 radiate outwardly from the disrupting member 106 connecting the disrupting member with the front wall 96. The ribs 108 have a width that is equal to the width of the nozzle assembly front wall 96. As best seen in FIG. 3, the ribs 108 are spacially arranged around the disrupting member 106 defining a plurality of outlet ports 110 through the front wall and spacially arranged around the disrupting member 106. As best seen in FIG. 4, the disrupting member 106 is a sphere having a cross-section diameter that is larger than the thickness of the front wall 96. This results in a portion of the sphere extending downstream beyond the exterior surface 100 of the front wall and a portion of the sphere extending upstream beyond the interior surface 98 of the front wall.

In operation of the trigger sprayer to dispense a foam, the foaming nozzle assembly 12 is inserted into the outlet passage 80 in the position shown in FIGS. 1 and 2. When the trigger sprayer is actuated, the liquid will be dispensed through the discharge orifice 58 in a conical spray pattern. Because the base of the foaming nozzle assembly has a smaller interior diameter than that of the outlet passage 80, a portion of the conical spray pattern dispensed will contact the interior surface 98 of the foaming nozzle assembly. This contact creates turbulence in the liquid which mixes the liquid with air and produces a foam from the liquid. The remaining portion of the liquid spray discharged through the discharge orifice 58 contacts the radiating ribs 108 and the disrupting member 106. The contact of the liquid with the ribs 108 creates a turbulence in the liquid that mixes it with air and produces a foam from the liquid. The spray of liquid contacting the sphere travels around the exterior surface of the sphere in the downstream direction. As the liquid contacts the sphere on its upstream side, a turbulence is created in this liquid which mixes the liquid with air and produces foam. The liquid and foam traveling around the sphere in the downstream direction draws liquid and foam being discharged through the outlet ports 110 toward the sphere due to the surface tension of the liquid. This has a tendency to draw the discharged foam passing through the outlet ports 110 toward the center axis of the foaming nozzle assembly 112. This draws discharged foam in toward the center of the usual conical pattern of discharge of liquid passing through the discharge orifice 58 created by the swirl chamber 66. In this manner, the usual circular or annular ring pattern of spray discharge created by the swirl chamber 66 is converted to a more uniform circular pattern of foam discharge with a portion of the foam created by the foaming nozzle being drawn toward the center of the typical annular ring pattern of sprayer discharge.

Figure 5:
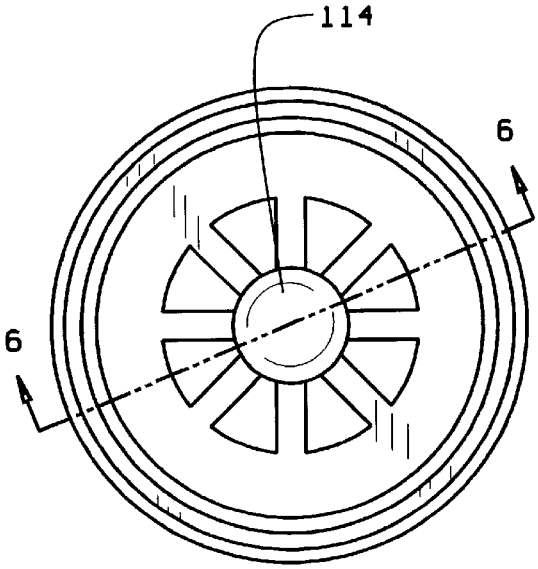
FIGS. 5 and 6 are views similar to those of FIGS. 3 and 4 showing an alternate embodiment of the foaming nozzle assembly.
Figure 6:
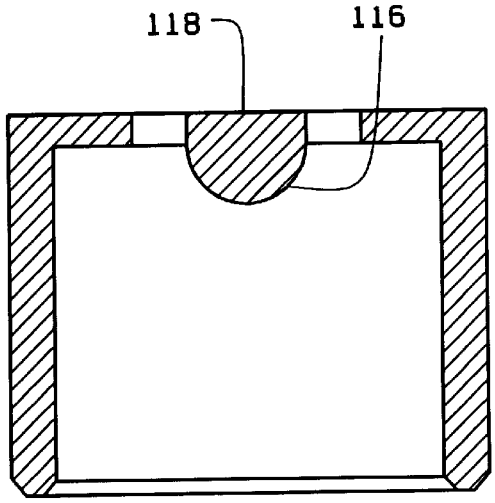

FIGS. 5–8 show two other variant embodiments of the foaming nozzle assembly of the present invention. In the embodiment of FIGS. 5 and 6, all component parts of the foaming nozzle assembly are the same as the previously described embodiment except for the disrupting member 114. In the embodiment of FIGS. 5 and 6, the disrupting member 114 has a semi-spherical configuration with a spherical surface 116 facing upstream in the nozzle assembly and a flat circular surface 118 facing downstream. This foaming nozzle assembly functions in the same manner as the previously described foaming nozzle assembly, however better results have been achieved with the first described embodiment of the foaming nozzle assembly.

Figure 7:
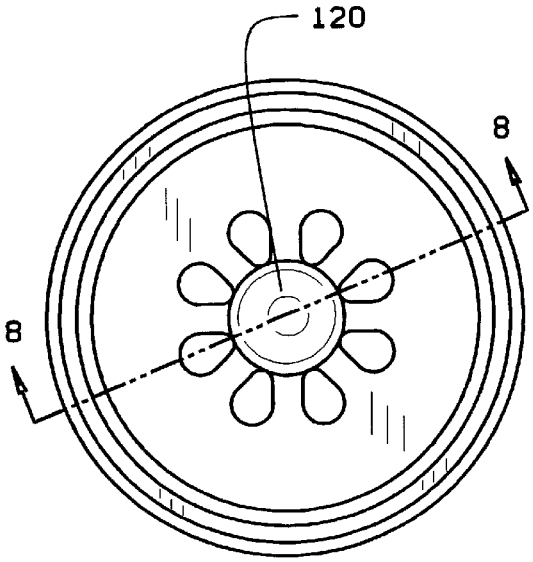
FIGS. 7 and 8 are views similar to FIGS. 3 and 4 and FIGS. 5 and 6 showing a further alternate embodiment of the foaming nozzle assembly.
Figure 8:
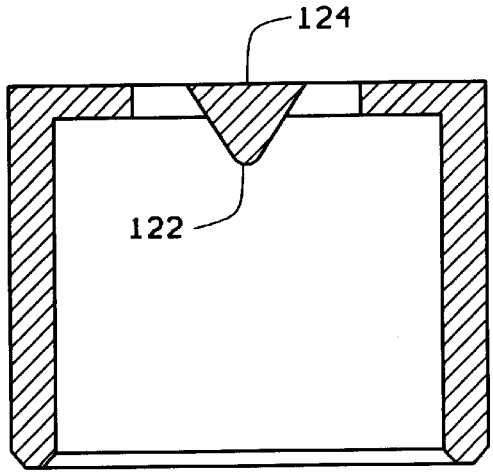

FIGS. 7 and 8 show a foaming nozzle assembly embodiment that is identical to the first described embodiment except for its disrupting member 120. The disrupting member 120 of this embodiment has a conical shape with the apex 122 of the cone facing upstream and the circular base 124 of the cone facing downstream. This foaming nozzle assembly functions in the same manner as the first described embodiment of the foaming nozzle assembly. However, better results have been achieved with the first embodiment of the foaming nozzle assembly.

While the present invention has been described by reference to a specific embodiment, it should be understood that modifications and variations of the invention may be constructed without departing from the scope of the invention defined in the following claims.

What is claimed is:

1. A foaming nozzle for a trigger sprayer comprising:

a base having a discharge passage therethrough;

the discharge passage having an inlet orifice at one end and a front wall at an opposite end;

the front wall having at least one outlet orifice extending therethrough;

a foam producing generator disposed in the outlet orifice;

the foam producing generator having at least one disrupting member with a semispherical surface positioned within the outlet orifice and a plurality of spaced ribs disposed within the outlet orifice and extending between the disrupting member and the front wall, the plurality of spaced ribs having a plurality of discharge ports therebetween;

the at least one disrupting member, the plurality of spaced ribs and the plurality of discharge ports being relatively positioned to produce a foam from a liquid when the liquid is passed therethrough.

2. The foaming nozzle of claim 1, wherein:

the at least one disrupting member is spherical.

3. The foaming nozzle of claim 1, wherein:

the semispherical surface faces toward the discharge passage inlet orifice.

4. The foaming nozzle of claim 1, wherein:

the semispherical surface faces away from the discharge passage.

5. The foaming nozzle of claim 1, wherein:

the plurality of spaced ribs have cylindrical cross sections.

6. The foaming nozzle of claim 1, wherein:

the spaced ribs extend radially from the at least one disrupting member.

7. The foaming nozzle of claim 1, wherein:

the front wall has an exterior surface that faces away from the discharge passage inlet orifice and the disrupting member projects outwardly from the exterior surface.

8. The foaming nozzle of claim 1, wherein:

the front wall has an interior surface that faces toward the discharge passage inlet orifice and the disrupting member projects outwardly from the interior surface.

9. The foaming nozzle of claim 1, wherein:

the front wall has an exterior surface that faces away from the discharge passage inlet orifice and an opposite interior surface that faces toward the discharge passage inlet orifice, and the disrupting member is disposed within the outlet orifice with a portion of the disrupting member projecting outwardly from the front wall interior surface.

10. The foaming nozzle of claim 9, wherein:

the front wall exterior surface is positioned in a plane and the front wall interior surface is positioned in a plane and the plurality of ribs are positioned between the planes of the front wall exterior and interior surfaces.

11. A foaming nozzle for a trigger sprayer comprising:

a peripheral base extending around an outlet orifice passing through the base, a disrupting member positioned within the outlet orifice, a plurality of ribs extending across the outlet orifice between the disrupting member and the base, and a portion of the disrupting member projects outwardly from the outlet orifice past the plurality of ribs.

12. The foaming nozzle of claim 11, wherein:

the outlet orifice has an upstream end and a downstream end where a flow of fluid is to pass through the outlet orifice from the upstream end to the downstream end in generating foam with the foaming nozzle, and the portion of the disrupting member projects outwardly past the orifice upstream end.

13. The foaming nozzle of claim 11, wherein:

the portion of the disrupting member is semi-spherical.

14. The foaming nozzle of claim 13, wherein:

the disrupting member is a sphere.

15. The foaming nozzle of claim 11, wherein:

the plurality of ribs are spatially arranged around the disrupting member and are positioned between a plane of the exterior surface and a plane of the interior surface of the front wall.

16. A foaming trigger sprayer comprising:

a housing having a connector that attaches the housing to a separate liquid container;

a liquid passage having an output opening;

a pump in the housing communicating with the liquid passage and the liquid container when the housing is attached to the liquid container by the connector, the pump having a mechanism that is operable to draw liquid from the liquid container and into the pump and to discharge the liquid from the pump through the liquid passage and the output opening; and a foaming nozzle in the liquid passage adjacent the output opening, the foaming nozzle having a peripheral base in friction engagement with the liquid passage and extending around an outlet orifice of the foaming nozzle, a disrupting member positioned in the outlet orifice and a plurality of ribs extending across the orifice between the disrupting member and the base defining a plurality of discharge ports within the orifice between the plurality of ribs, and a portion of the disrupting member projecting beyond the plurality of ribs and away from the output opening.

17. The foaming trigger sprayer of claim 16, wherein:

the portion of the disrupting member has a semi-spherical shape.

18. The foaming trigger sprayer of claim 16, wherein:

the disrupting member is spherical.

19. The foaming trigger sprayer of claim 16, wherein:

the portion of the disrupting member has a conical shape.

20. A foaming nozzle for a trigger sprayer comprising:

a base having a discharge passage therethrough;

the discharge passage having an inlet orifice at one end and a front wall at an opposite end;

the front wall having at least one outlet orifice extending therethrough;

a foam producing generator disposed in the outlet orifice;

the foam producing generator having at least one disrupting member positioned within the outlet orifice and a plurality of spaced ribs disposed within the outlet orifice and extending between the disrupting member and the front wall, the plurality of spaced ribs having a plurality of discharge ports therebetween;

the at least one disrupting member, the plurality of spaced ribs and the plurality of discharge ports being relatively positioned to produce a foam from a liquid when the liquid is passed therethrough; and the disrupting member projecting outwardly from the outlet orifice and having a diminishing cross-section as it projects outwardly so as to circumduct a portion of said foam, thereby altering the dispersion pattern of the foam.

21. The foaming nozzle of claim 20, wherein:

the disrupting member is spherical.

22. The foaming nozzle of claim 20, wherein:

the disrupting member is semispherical.

23. The foaming nozzle of claim 20, wherein:

the disrupting member projects outwardly away from the inlet orifice.

* * * * *